United States Patent [19]

Seider et al.

[11] 3,982,097

[45] Sept. 21, 1976

[54] PROGRAMMABLE ELECTRONIC CONTROL SYSTEM FOR MULTIPLE ELECTRIC STATIONS

[75] Inventors: Gene J. Seider, Bloomington; Michael C. Freund, Mendota Heights, both of Minn.

[73] Assignee: Gould Inc., Rolling Meadows, Ill.

[22] Filed: Apr. 30, 1975

[21] Appl. No.: 573,344

[52] U.S. Cl. ..... 219/486; 219/483; 219/497; 219/501

[51] Int. Cl.[2] ..... H05B 1/02

[58] Field of Search ..... 219/480, 483, 486, 490, 219/494, 497, 499, 501

[56] References Cited

UNITED STATES PATENTS

| | | | |
|---|---|---|---|
| 3,227,858 | 1/1966 | Rees | 219/497 X |
| 3,315,063 | 4/1967 | Ihlenfeldt | 219/497 |
| 3,371,191 | 2/1968 | Seney | 219/497 X |
| 3,431,399 | 3/1969 | Venning | 219/497 |
| 3,560,712 | 2/1971 | Toohill | 219/483 |
| 3,566,079 | 2/1971 | O'Neill | 219/501 X |
| 3,579,264 | 5/1971 | Mork et al. | 219/486 |
| 3,855,452 | 12/1974 | Flasza et al. | 219/501 X |

*Primary Examiner*—J D Miller
*Assistant Examiner*—Fred E. Bell
*Attorney, Agent, or Firm*—Leydig, Voit, Osann, Mayer & Holt, Ltd.

[57] ABSTRACT

A programmable electronic control system for an array of electrical stations exemplified by food tray stations each of which is adapted to receive a food tray having two or more electrical heaters embedded in the tray. Each tray is detachable from its station. A separate power circuit is associated with each heater element at each tray station for supplying separately controllable power to each individual heater. A manually controlled programming channel is connected to each power circuit and includes means for generating control signals to enable or disable each separate power circuit to permit the programming of the entire array of tray stations. A manually controlled station reset device is connected to the programming channels for each tray station to remove any enabling control signals generated by the respective programming channels for that station to permit the re-programming of individual tray stations. A manually controlled master reset device is connected to all the programming channels for all the stations to remove any enabling control signals generating by any of the programming channels to permit the re-programming of the entire array of tray stations. A tray sensing device disables the power circuits associated with the respective tray stations whenever trays are absent from the respective stations, and enable the programming channels associated with the respective tray stations whenever trays are present at the respective stations. A locking device is provided for locking in all the control signals to prevent the re-programming or clearing of any of the tray stations after a complete program has been selected.

24 Claims, 2 Drawing Figures

PROGRAMMABLE ELECTRONIC CONTROL SYSTEM FOR MULTIPLE ELECTRIC STATIONS

CROSS REFERENCES TO RELATED APPLICATIONS

1. Ser. No. 468,404 filed May 9, 1974 entitled "Food Serving System".
2. Ser. No. 570,191 filed Apr. 21, 1975 entitled "Food Service Vehicle" (Seider and Freund).
3. Ser. No. 573,078 filed Apr. 30, 1975 entitled "Storage System For Hot Food Trays" (Seider, Freund and Duffy).
4. Ser. No. 573,079 filed Apr. 30, 1975 entitled "Food Service Vehicle" (Seider, Freund and Duffy).
5. Ser. No. 573,100 filed Apr. 30, 1975 entitled "Control Circuit For Electrically Propelled Vehicle" (Seider and Freund).
6. Ser. No. 573,080 filed Apr. 30, 1975 entitled "Battery Charging System" (Seider and Freund).

DESCRIPTION OF THE INVENTION

The present invention relates generally to programmable control systems for an array of electrical stations and, more particularly, to an electronic system for controlling electrical power circuits associated with heating elements in a plurality of food electrical stations.

The control system provided by this invention is particularly useful in controlling the heating of food service trays in a food serving cart of the type described in pending application Ser. No. 468,404, filed May 9, 1974, and entitled "Food Serving System." The cart is intended for use in delivering hot meals to locations remote from the kitchen or other facility where the meals are prepared, particlarly in hospitals, nursing homes and the like. Each tray contains two or more heating elements formed as integral parts of the tray, and while the trays are in the cart the heating elements are energized to maintain the meals thereon at their desired temperatures.

It is a primary object of the present invention to provide an electronic control system which permits separate manual programming of selected power circuits at a plurality of different stations.

Another object of the invention is to provide such an electronic control system which facilitates re-programming the power circuit associated with any given station if a mistake is made in the original program or if it is desired to change the program.

It is a further object of the invention to provide an electronic control system of the foregoing type which includes automatic safety features to prevent exposure of operating personnel to the electrical power that energizes the various stations.

Yet another object of the invention is to provide such an electronic control system which permits a selected program for the various power circuits to be locked into the system after the initial selection of the program.

Figure 1:
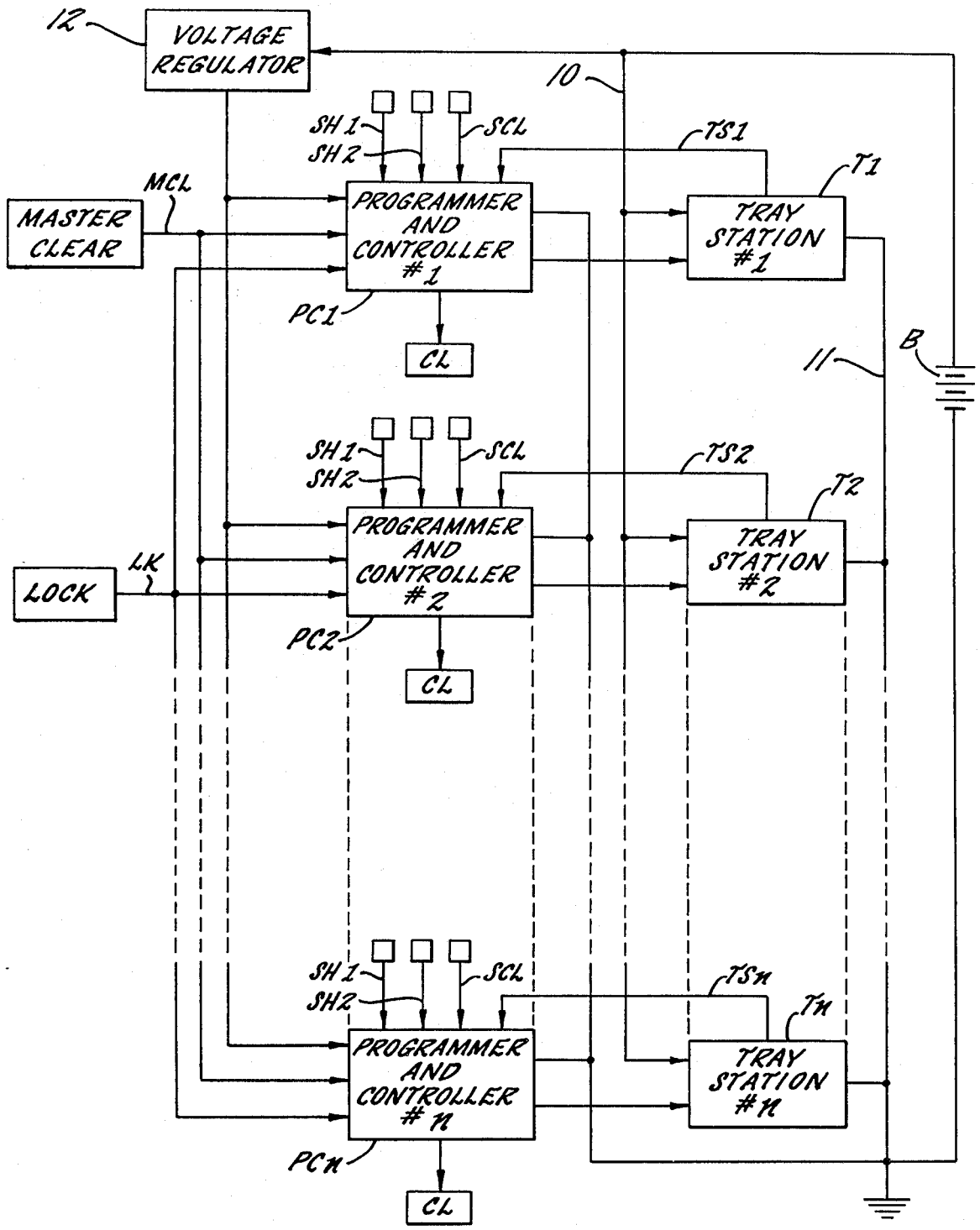
Figure 2:
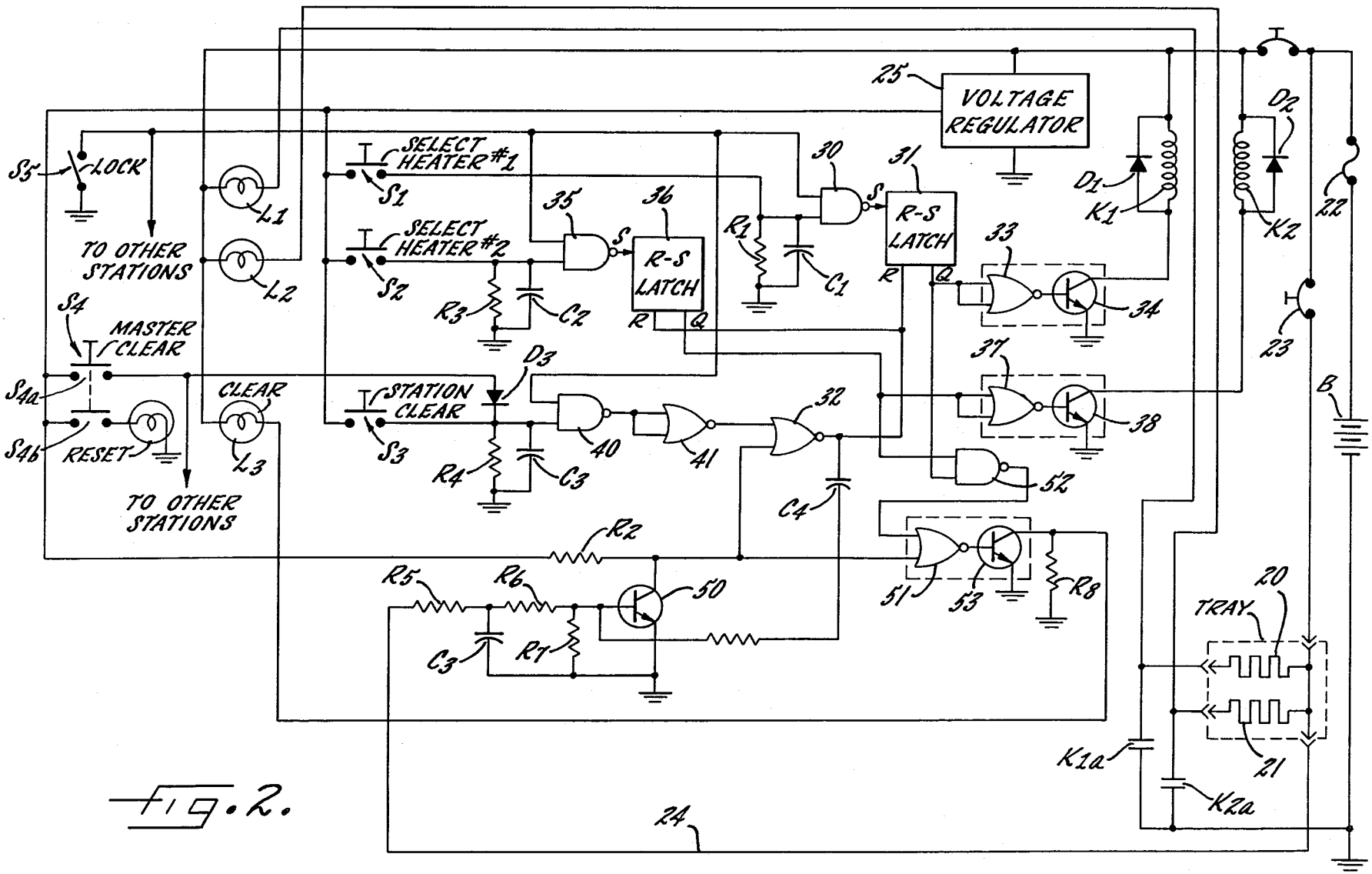

Other objects and advantages of the invention will be apparent from the following detailed description and the accompanying drawings, in which:

FIG. 1 is a block diagram of a control system embodying the invention for controlling two or more heating elements at each of a multiplicity of food tray positions; and FIG. 2 is a more detailed schematic diagram of an exemplary circuit corresponding to the block diagram of FIG. 1.

While the invention will be described in connection with a preferred embodiment, it will be understood that it is not intended to limit the invention to that embodiment. On the contrary, it is intended to cover all alternatives, modifications and equivalents as may be included within the spirit and scope of the invention as defined by the appended claims.

Before considering the control system illustrated in the drawings, it will be helpful to note the symbols and conventions which have been employed in certain figures to diagrammatically represent different logic devices and signals. In this connection, the system shown in the drawings operates on a binary logic basis, i.e., each signal which is produced and responded to may have either a binary 1 or 0 value. These might be, for example, voltage levels of +5 volts and zero volts, respectively, which is "positive" logic since the most positive logic voltage level is defined to be the logical 1 state, while the most negative logic voltage level is defined to be the logical 0 state. The system illustrated generally responds affirmatively to binary 1 signals, and normally produces no response when any given signal has a binary 0 value.

The term "flip-flop" or "latch" is used herein to designate a device that exhibits two different stable states. The illustrative system utilizes one particular type of flip-flop, namely the R-S latch. The R-S latch has either one or two asynchronous control inputs, set (S) and reset (R), and it may have either or both Q and $\bar{Q}$ outputs available. The output changes immediately when either control input changes. Thus, when the set input changes to a binary 0, the Q output changes to a binary 0, and when the reset input changes to a binary 0, the Q output changes to a binary 1. The state where both the control inputs are binary 0's is not permitted, and the state where both control inputs are binary 1's produces no change in either the Q or $\bar{Q}$ output.

NAND and NOR gates have been illustrated by the conventional symbols exemplified by the gates 30 and 33 in FIG. 2. As is well known, the output of the NAND gate is always a binary 1 signal except when all inputs are binary 1 signals, in which case the output becomes a binary 0 signal. The output of the NOR gate is a binary 1 only when all inputs are binary 0 signals; whenever at least one of the inputs is a binary 1 signal, the output is a binary 0 signal.

Turning now to the drawings the invention will be described with specific reference to an exemplary hot food service or storage system, but it will be understood that the invention is equally applicable to many other types of systems having multiple stations for different purposes. Referring first to FIG. 1, there is illustrated a system for controlling an array of hot food stations T1, T2 . . . Tn, each of which is adapted to receive a food tray having a plurality of electrical heaters therein. This system is particularly suitable for use with a portable hot food serving cart of the type described in co-pending application Ser. No. 468,404 filed May 9, 1974, and Ser. Nos. 573078, 573079, and 573100, filed concurrently herewith, but the system is also suitable for use with other types of hot tray storage systems, or arrays of electrical heaters for other applications.

In the illustrative system, the electrical heaters at each of the tray stations T1–Tn is supplied with power from a battery B via lines 10 and 11. Within each tray station is a switch for connecting and disconnecting the battery B and the respective heating elements, and the switch at each tray position is controlled by a separate programmer and controller PC1, PC2 . . . PCn. The inputs to each programmer and controller PC1-14 PCn include a control voltage from a voltage regulator 12, two manually controlled "select heater" input signals SH1 and SH2, a manually controlled "station clear" signal SCL, a manually controlled "master clear" signal MCL, a manually controlled "lock"signal LK, and a "tray present" or "tray absent" signal fed back from each tray station via feedback line TS. The outputs from each programmer and controller PC1–PCn control the power switch for the corresponding tray station and a "clear" indicator CL for each station.

In accordance with one important aspect of the present invention, each programmer and controller includes means responsive to the "select heater" input signals SH1 and SH2 to enable or disable each separate power circuit in the respective tray stations T1–Tn to permit the programming of the entire array of tray stations, means responsive to the station clear signal SCL for removing any enabling control signals generated in response to the signals SH1 and SH2 to permit the re-programming of individual tray stations, means responsive to the master clear signal MCL for removing any enabling control signals generated in response to any of the input signals SH1 and SH2 to permit the re-programming of the entire array of tray stations, means for disabling the power circuits associated with the respective tray stations in response to a "tray absent" signal on the feedback line TS and means for enabling the power circuits in response to a tray present signal on the feedback line TS. Thus, in the illustrative system of FIG. 1, the combination of either or both of the select heater signals SH1 and/or SH2 with a tray present signal from the corresponding tray station produces an output signal from the corresponding programmer and controller that energizes either or both of the heater elements by closing the corresponding power switch or switches. After one or more of the heater elements are energized at any tray station, those elements remain energized until (1) the tray is removed from that particular station to generate a tray absent signal on the feedback line TS, or (2) a station clear signal is generated for that particular station, or (3) a master clear signal is generated for all tray stations. The application of any one of these three signals to one of the programmer and controller units removes the enabling output signal from that particular unit and de-energizes the heater elements at the corresponding tray station.

In the event that a tray present signal is received at any given programmer and controller unit in the absence of both select heater signals SH1 and SH2, that particular programmer and controller automatically produces an output signal to activate the station clear indicator CL. This provides a signal to the operator that a tray is in position without any program for heating it.

In accordance with another important aspect of the invention, each of the programmer and controller units PC1–PCn includes means for locking in all the control signals to prevent the re-programming or clearing of any of the tray stations. Thus, in the illustrative system each of the programmer and controller units PC1–PCn includes means responsive to the lock input signal LK for preventing any of the other input signals SH1, SH2, SCL, MCL or either a tray present or tray absent signal on line TS from altering the output signal of the programming and controlling unit. It should be noted that this lock input signal LK is common to all the tray stations so that it locks in the program for the entire array of stations.

A preferred embodiment of a portion of the control system of FIG. 1, for only one tray station, is shown in more detail in FIG. 2. In this system, heater elements 20 and 21 (e.g. embedded in a food tray) at a tray station TS1 are supplied with power from a battery B through a fuse 22, a circuit breaker 23, and a pair of relay contacts K1*a* and K2*a* which are used to turn the power circuits on and off. The contacts K1*a* and K2*a* are closed by energizing respective relay coils K1 and K2, which in turn are part of a control system responsive to the five manual inputs illustrated in FIG. 1, namely: a pair of heater select switches S1 and S2, a station clear switch S3, a master clear switch S4, and a lock switch S5. The control system is also responsive to a tray present or tray absent signal produced on line 24 whenever the heating elements 20 and 21 are connected into their power circuits. The primary source of the binary 1 voltage in the illustrative system is a voltage regulator 25 which is connected to the battery B through a circuit breaker 26 and produces a constant voltage output at a level substantially below that of the battery B, e.g., a constant 5 volts.

The select heater switches S1 and S2 are used to program the heating elements 20 and 21, i.e., to enable one or both of the relays K1 and K2 for energization to activate the corresponding heater power circuit or circuits by closing one or both of the relay contacts K1*a* and K2*a*, respectively. Thus, when the first select heater switch S1 is closed, it connects the voltage regulator 25 to ground through a resistor R1, thereby applying a binary 1 signal to one input of a NAND gate 30. A capacitor C1 connected in parallel with the resistor R1 prevents line noise from being interpreted as a signal by shunting it to ground. The other input to the gate 30 is normally connected to a continuous binary 1 signal source (not shown). Consequently, the binary 1 applied to the NAND gate 30 by the closing of the switch S1 changes the output of the gate 30 from a binary 1 to a binary 0, which is applied to the set input of an R-S latch 31. The reset input of the latch 31 normally receives a continuous binary 1 signal as long as the heater elements 20 and 21 are connected in their power circuits, as will be described in more detail below. As a result, when the signal at the set input of the latch 31 changes from a binary 1 to 0, the Q output of the latch 31 changes to a binary 0. This 0 is applied to a NOR gate 33 which has its inputs interconnected to function as an inverter, thereby producing a binary 1 on the base of a transistor 34. This renders the transistor 34 conductive, thereby energizing the relay K1 by connecting it to ground so that current flows therethrough from the battery B. Thus, it can be seen that the gate 33 and transistor 34 from a driver for the relay coil K1, with the driver being actuated by a binary 0 output from the latch 31. A diode D1 is connected in parallel with the relay coil K1 to protect the transistor 34 from the inductive voltage of the coil K1.

Energization of the relay K1 closes the contacts K1*a* to close the power circuit to the heater element 20. In order to provide a visible indication that the heater element 20 has been energized the closing of the relay contacts K1*a* also energizes an indicator light L1 from the battery B.

Although the select heater switch S1 is only a momentary switch, it will be appreciated that the programming signal produced by the momentary closing of this switch is retained by the R-S latch 31. That is, even though the binary 0 at the set input of the latch 31 reverts to a binary 1 as soon as the switch S1 re-opens, no change occurs in the binary 0 produced at the Q output of the flip-flop. The only way to change the output of the latch 31 is to change the binary 1 signal at the reset input to a binary 0 while a binary 1 is present at the set input.

When the second select heater switch S2 is closed, it connects the voltage regulator 25 to ground through a resistor R3, thereby applying a binary 1 signal to one input of a NAND gate 35. A capacitor C2 connected parallel with the resistor R3 shunts line noise to ground to prevent it from being interpreted as a signal. The other input normally connected to a continuous binary 1 signal source (not shown). Consequently, the binary 1 applied to the NAND gate 35 by the closing of the switch S2 changes output of the gate 35 from a binary 1 to a binary 0, which is applied to the set input of an R-S latch 36. The reset input of the latch 36 normally receives a continuous binary 1 signal as long as the heater elements 20 and 21 are connected in their power circuits, as will be described in more detail below. As a result, when the signal at the set input of the latch 36 changes from a binary 1 to 0, the Q output of the latch 36 changes to a binary 0. This 0 is applied to a NOR gate 37 which has its inputs interconnected to function as an inverter, thereby producing a binary 1 on the base of a transistor 38. This renders the transistor 38 conductive, thereby energizing the relay K2 by connecting it to ground so that current flows therethrough from the battery B. Thus, it can be seen that the gate 37 and transistor 38 form a driver for the relay coil K2, with the driver being actuated by a binary 0 output from the latch 36. A diode D2 is connected in parallel with the relay coil K2 to protect the transistor 38 from the inductive voltage of the coil K2.

Energization of the relay K2 closes the contacts K2*a* to close the power circuit to the heater element 21. In order to provide a visible indication that the heater element 20 has been energized the closing of the relay contacts K2*a* also energizes an indicator light L2 from the battery B.

Although the select heater switch S2 is only a momentary switch, it will be appreciated that the programming signal produced by the momentary closing of this switch is retained by the R-S latch 36. That is, even though the binary 0 at the set input of the latch 36 reverts to a binary 1 as soon as the switch S2 re-opens, no change occurs in the binary 0 produced at the Q output of the flip-flop. The only way to change the output of the latch 36 is to change the binary 1 signal at the reset input a binary 0 while a binary 1 is present at the set input.

There are three different inputs to the control system which are capable of changing the reset inputs to the latches 31 and 36 to binary 0's, thereby producing binary 1's at the outputs of the latches to render the transistors 34 and 38 non-conductive and de-energize the relay coils K1 and K2. These three inputs are (1) the station clear switch S3, (2) the master clear switch S4, and (3) a tray absent signal on line 24. Turning first to the station clear switch S3, when this switch is momentarily closed, it connects the voltage regulator 25 to ground through a resistor R4, thereby applying a binary 1 signal to one input to a NAND gate 40. A capacitor C3 across the resistor R4 shunts line noise to ground. The other input to this gate 40 is normally connected to a continuous binary 1 signal source (not shown), so the closing of the switch S3 results in the production of a binary 0 at the output of the gate 40. This binary 0 is inverted by a NOR gate 41 having its inputs interconnected to function as an inverter, and the resulting binary 1 signal is applied to the NOR gate 32 so as to produce a binary 0 signal which is applied to the reset inputs of both the latches 31 and 36. This converts the outputs of the two latches from binary 0's to 1's, thereby turning off both the transistors 34 and 38 and de-energizing the corresponding relay coils K1 and K2. Of course, the de-energization of the relay coils K1 and K2 opens the corresponding contacts K1*a* and K2*a* to de-energization the heating elements 20 and 21, respectively. Thus, both the power circuits to the heating elements and the two heater programming channels associated with the select heater switches S1 and S2 are reset to their inoperative states.

The master clear switch S4 operates in the same manner as the station clear switch S3, except that the master clear switch S4 is connected to the entire array of tray or heater stations, not just the one station illustrated in FIG. 2. Thus, when the master clear switch S4 is closed, the contact S4*a* applies a binary 1 signal to the NAND gate 40 through a diode D3, thereby de-energizing the relay coils K1 and K2 in the same manner described above the for the station clear switch S3. This same binary 1 signal is also applied via line 42 to similar NAND gates associated with all the other tray stations. The second contact S4*b* of the master clear switch S4 energizes a "reset" indicator light to provide a visible indication that the entire control system has been reset.

To disable the heater programming channels whenever the heater elements 20 and 21 are absent from their power circuits, the tray present and tray absent signals on line 24 control the enabling and disabling of the two R-S latches 31 and 36. When the heater elements 20 and 21 are in place, the tray present signal (binary 1) is applied via a voltage divider formed by resistors R5, R6 and R7 to the base of a transistor 50, thereby rendering the transistor 50 conductive. This connects one of the inputs of the NOR gate 32 to ground, thereby producing a binary 1 at the output of the gate 32, which is connected directly to the reset inputs of the two R-S latches 31 and 36. This, of course, enables the two latches 31 and 36 so that the subsequent application of a binary 0 to the set input of either of these latches produces a binary 0 at the Q output of the latch. When the heater elements 20 and 21 are absent from their power circuits, the signal on line 24 changes to a binary 0, i.e., a tray absent signal, which renders the transistor 50 non-conductive so that the voltage regulator 25 applies a binary 1 to the input of the NOR gate 32. This produces a binary 0 at the output of the NOR gate 32 which is applied to the reset inputs of the latches 31 and 36, thereby disabling the latches 31 and 36 so that a binary 1 is maintained at the Q output of each latch regardless of whether a binary 1 or 0 is applied to the set input.

Upon removal of food tray from the station Ts1 and the resulting disconnection of the heater elements 20 and 21 from their power circuits, a capacitor C4 connected across the base-emitter circuit of the transistor 50 discharges to hold the transistor 50 in a conductive state for a predetermined time interval, e.g., 15 seconds, before the transistor 50 is rendered non-conductive. This time delay avoids the need to re-program the system in the event that the tray is accidentally removed from the tray station TS1 for a brief interval and then immediately re-inserted. After the transistor 50 is rendered non-conductive, a capacitor or C5 connected between output base of the transistor 50 and the ouput of the NOR gate 32 discharges back through the NOR gate 32 to ground to draw circuit away from the base of the transistor 50 while the capacitor C4 continues to discharge, thereby ensuring that the transistor 50 remains non-conductive and does not oscillate. This prevents any possibility of producing a voltage across the exposed electrical contacts provided at the tray station TS1, which is an important safety feature.

It is also desirable to visibly indicate when the heater elements 20 and 21 are in place, but neither of them has been programmed for energization. When this situation exists, the tray present signal (a binary 1) on line 24 renders the transistor 50 conductive to apply a binary 0 to one of the inputs to a NOR gate 51. The other input to this NOR gate 51 is the output of a NAND gate 52 whose two input lines are connected to the outputs of the R-S latches 31 and 36. When neither of the heaters 20 and 21 has been programmed for energization, the outputs of both the latches 31 and 36 are binary 1's, thereby producing a binary 0 at the output of the gate 52 and at the second input to the NOR gate 51. When this condition prevails, i.e., with binary 0's on both of the inputs to the NOR gate 51, a binary 1 is produced at the output of the gate 51, and applied to the base of a transistor 53. This renders the transistor 53 conductive to energize a clear light L3 which indicates that the heater elements 20 and 21 are in place but have not yet been programmed. A resistor R8 connected across the emitter-collector circuit of the transistor 53 draws a "keep alive" current through the clear light L3, while the light is de-energized, to avoid any surge of current through the transistor 53 when it is rendered conductive.

In order to permit the operator of the system to lock in all the control signals and prevent any re-programming or clearing of the various heater stations, a lock switch S5 is connected between ground and the second inputs of the three NAND gates 30, 35 and 40. When this switch S5 is closed, it applies a binary 0 to the three NAND gates to ensure that binary 1 signals are maintained at the outputs of all three gates 30, 35 and 40. In other words, the closing of the switch S5 disables all three of the NAND gates 30, 35 and 40 so that none of the corresponding switches S1, S2 or S3 can have any effect on the control system even if they are closed.

We claim as our invention:

1. A programmable electronic control system for an array of food tray stations each of which is adapted to receive a food tray having a plurality of electrical heaters therein, said system comprising the combination of a. a plurality of controllable power circuits associated with each tray station for supplying separately controllable power to each individual heater, b. manually operable programming means connected to each power circuit and including means for generating control signals to enable or disable each separate power circuit to permit the programming of the entire array of tray stations, c. manually operable station reset means connected to each programming means for removing any enabling control signals generated by the respective programming means to permit the re-programming of individual tray stations, d. manually operable master reset means connected to all the programming means for removing any enabling control signals generated by any of the programming means to permit the re-programming of the entire array of tray stations, e. and tray sensing means at each tray station for disabling the power circuits associated with the respective tray stations in response to the absence of trays at the respective stations, and for enabling the programming means associated with the respective tray stations in response to the presence of trays at the respective stations.

2. A programmable electronic control system as set forth in claim 1 which includes means for locking in all the control signals to prevent the re-programming or clearing of any of the tray stations.

3. A programmable electronic control system as set forth in claim 2 wherein said locking means includes electronic gating means connected to said programming means, said station reset means, and said master reset means, and means for supplying a disabling signal to said gating means for rendering said programming means, said station reset means, and said master reset means ineffective.

4. A programmable electronic control system as set forth in claim 1 wherein each programming means includes a bistable electronic device for producing said enabling and disabling control signals, and each tray sensing means includes means for maintaining the bistable device in the state which produces the disabling control signal as long as there is no tray present at the corresponding station.

5. A programmable electronic control system as set forth in claim 4 wherein each programming means includes a manually operable switch, and said bistable device is responsive to the combination of a closed condition of said switch and an enabling signal from said tray sensing means for producing said enabling control signal for the corresponding power circuit.

6. A programmable electronic control system as set forth in claim 4 wherein said station reset means includes means for setting said bistable device to the state which produces the disabling control signal.

7. A programmable electronic control system as set forth in claim 4 wherein said master reset means includes means for setting all of said bistable devices to the state which produces the disabling control signal.

8. A programmable electronic control system as set forth in claim 1 which includes indicating means associated with each tray station and responsive to the combination of (1) an enabling signal from said tray sensing means indicating the presence of a tray at said station and (2) a disabling control signal from said programming means, for producing a signal indicating that a tray is present at said station and has not been programmed.

9. A programmable electronic control system as set forth in claim 1 which includes means responsive to a disabling signal from each tray sensing means for removing any enabling control signals from the corresponding programming means.

10. A programmable electronic control system as set forth in Claim 9 wherein said means responsive to a disabling signal from said tray sensing means includes time delay means for removing said enabling control signals from said programming means only after a predetermined time delay following the generation of the disabling signal by the tray sending means.

11. A programmable electronic control system as set forth in claim 1 wherein each of said power circuits includes a power source and controllable switch means for connecting and disconnecting the power source and heating elements, and said programming means includes means for generating control signals to open and close said switch means.

12. A programmable electronic control system for an array of electrical heating stations each of which includes a plurality of electrical heaters, said system comprising the combination of a. a plurality of controllable power circuits associated with each station for supplying separately controllable power to each individual heater.

b. programming means connected to each power circuit and including means for generating control signals to enable or disable each separate power circuit to permit the programming of the entire array of heater stations, c. station reset means connected to each programming means for removing any enabling control signals generated by the respective programming means to permit the re-programming of individual heater stations, d. master reset means connected to all of the programming means for removing any enabling control signals generated by any of the programming means to permit the re-programming of the entire array of heater stations, e. and means for locking in all the control signals to prevent the re-programming or clearing of any of the heater stations.

13. A programmable electronic control system as set forth in claim 12 which includes sensing means at each heater station for disabling the power circuits associated with the respective stations in response to the absence of a preselected condition at the respective stations, and for enabling the programming means associated with the respective stations in response to the presence of said preselected condition at the respective stations.

14. A programmable electronic control system for an array of electrical stations, said system comprising the combination of a. a plurality of controllable power circuits associated with each station for supplying separately controllable power to each individual station, b. manually operable programming means connected to each power circuit and including means for generating control signals to enable or disable each separate power circuit to permit the programming of the entire array of stations, c. manually operable station reset means connected to each programming means for removing any enabling control signals generated by the respective programming means to permit the re-programming of individual stations, d. manually operable master reset means connected to all the programming means for removing any enabling control signals generated by any of the programming means to permit the re-programming of the entire array of stations, e. and sensing means at each station for disabling the power circuits associated with the respective stations in response to the absence of a preselected condition at the respective stations, and for enabling the programming means associated with the respective stations in response to the presence of said preselected condition at the respective stations.

15. A programmable electronic control system as set forth in claim 14 which includes means for locking in all the control signals to prevent the re-programming or clearing of any of the stations.

16. A programmable electronic control system as set forth in claim 15 wherein said locking means includes electronic gating means connected to said programming means, said station reset means, and said master reset means, and means for supplying a disabling signal to said gating means for rendering said programming means, said station reset means, and said master reset means ineffective.

17. A programmable electronic control system as set forth in claim 14 wherein each programming means includes a bistable electronic device for producing said enabling and disabling control signals, and each sensing means includes means for maintaning the bistable device in the state which produces the disabling control signal as long as said preselected condition is absent from the corresponding station.

18. A programmable electronic control system as set forth in claim 17 wherein each programming means includes a manually operable switch, and said bistable device is responsive to the combination of a closed condition of said switch and an enabling signal from said sensing means for producing said enabling control signal for the corresponding power circuit.

19. A programmable electronic control system as set forth in claim 17 wherein said station reset means includes means for setting said bistable device to the state which produces the disabling control signal.

20. A programmable electronic control system as set forth in claim 17 wherein said master reset means includes means for setting all of said bistable devices to the state which produces the disabling control signal.

21. A programmable electronic control system as set forth in claim 14 which includes indicating means associated with each station and responsive to the combination of (1) an enabling signal from said sensing means indicating the presence of said preselected condition at said station and (2) a disabling control signal from said programming means, for producing a signal indicating that said preselected condition is present at said station and said station has not been programmed.

22. A programmable electronic control system as set forth in claim 14 which includes means responsive to a disabling signal from each sensing means for removing any enabling control signals from the corresponding programming means.

23. A programmable electronic control system as set forth in claim 22 wherein said means responsive to a disabling signal from said sensing means includes time delay means for removing said enabling control signals from said programming means only after a predetermined time delay following the generation of the disabling signal by the sensing means.

24. A programmable electronic control system as set forth in claim 14 wherein each of said power circuits includes a power source and controllable switch means for connecting and disconnecting the power source and heating elements, and said programming means includes means for generating control signals to open and close said switch means.

* * * * *